United States Patent [19]

Pfalzgraf et al.

[11] 4,408,581

[45] Oct. 11, 1983

[54] DEVICE FOR CONTROLLING THE SPEED OF TRAVEL AND REGULATING THE IDLING SPEED OF AUTOMOTIVE VEHICLES WITH AN OTTO ENGINE

[75] Inventors: Manfred Pfalzgraf, Frankfurt am Main; Eckhart Kern, Hofheim; Harald Collonia, Glashütten, all of Fed. Rep. of Germany

[73] Assignee: VDO Adolf Schindling AG, Frankfurt am Main, Fed. Rep. of Germany

[21] Appl. No.: 313,884

[22] Filed: Oct. 22, 1981

[30] Foreign Application Priority Data

Oct. 24, 1980 [DE] Fed. Rep. of Germany ..... 3040144

[51] Int. Cl.[3] ..... F02M 3/00

[52] U.S. Cl. ..... 123/339; 123/586

[58] Field of Search ..... 123/337, 339, 399, 403, 123/586; 261/65; 180/170, 178, 179

[56] References Cited

U.S. PATENT DOCUMENTS

| | | | |
|---|---|---|---|
| 1,130,103 | 3/1915 | Plumm | 123/337 |
| 2,719,519 | 10/1955 | Sutton | 261/65 |
| 3,341,185 | 9/1967 | Kennedy, Sr. | 261/65 |
| 4,278,059 | 7/1981 | Collonia | 123/399 |

*Primary Examiner*—William A. Cuchlinski, Jr.
*Attorney, Agent, or Firm*—Martin A. Farber

[57] ABSTRACT

A system for controlling the vehicle speed of travel as well as for regulating the idling speed of automotive vehicles having an Otto engine, comprising an actuator which adjusts the position of a regulating element for control of the vehicle speed as a function of the position of a desired-value transmitter. A closure element, as well, which determines the through-put passage cross section of a by-pass, the latter connecting a region in front of the regulating element with a region behind the regulating element, the closure element being displaceable by an automatically controlled actuator. The first-mentioned actuator and the automatically controlled actuator constitute a single actuator means common both for controlling the vehicle speed of travel and for regulating the idling speed. The single actuator actuates the closure element for regulating the idling speed, in a first operating range and operates the regulating member for controlling the vehicle speed of travel in a second operating range.

13 Claims, 6 Drawing Figures

FIG.1
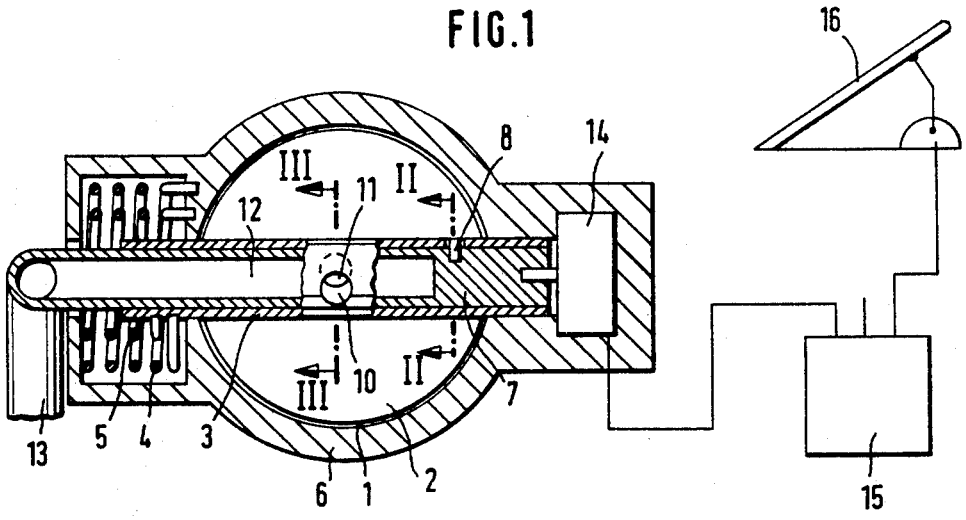
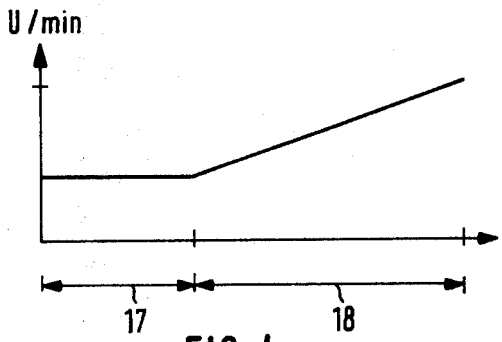
FIG.4
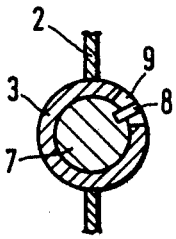
FIG.2
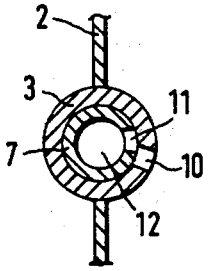
FIG.3
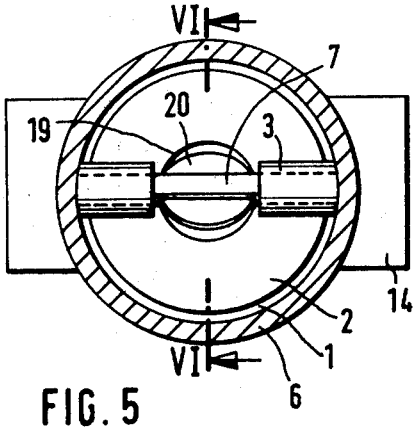
FIG. 5
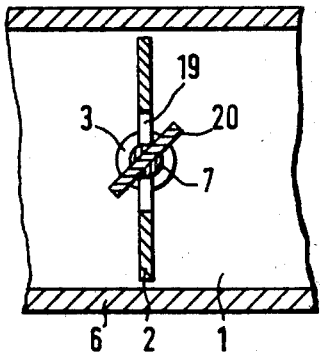
FIG.6

DEVICE FOR CONTROLLING THE SPEED OF TRAVEL AND REGULATING THE IDLING SPEED OF AUTOMOTIVE VEHICLES WITH AN OTTO ENGINE

The present invention relates to a device for controlling the speed of travel and regulating the idling speed of automotive vehicles having an Otto engine, with an actuator which adjusts the position of the regulating element for the vehicle speed control as a function of the position of a desired-value transmitter and a closure member which determines the cross section of passage of a by-pass which connects the region in front of the regulating member with the region behind it and can be displaced by an automatically controlled actuator.

In known devices the control of the idling speed and the control of the speed of travel are effected by two devices which are independent of each other. In other words, both the regulation of the idling speed and the regulation of the speed of travel are provided with their own regulating and closing elements, each of which is adjustable by its own actuator. Such a construction requires a large number of parts and also a large amount of space for installation. This is disadvantageous, in particular when the device is installed in an automotive vehicle since only a small space is available for installation.

The object of the present invention is therefore to provide a device in accordance with the introductory paragraph which is characterized by the fact that it requires only a small space for installation.

This object is achieved in accordance with the invention by a single actuator (14) common both for the control of the speed of travel and for the control of the idling speed, by which actuator the closure element (10, 20) for regulating the idling speed can be actuated in a first operating range (17) and the regulating member for the control of the speed of travel can be operated in a second operating range (18). By the common actuator for the control of the speed of travel and the control of the idling speed there is obtained a device which, in addition to saving installation space, also results in a substantial reduction in cost as compared with traditional devices.

If the actuator can be controlled in the idle position of the nominal or desired-value transmitter (16), by an idling speed electronic system and upon displacement of the desired-value transmitter (16) out of its idling position by the desired-value transmitter then a single electronic system can be used for both functions, which also results in a simplification of the device and a decrease in its cost. It is particularly favorable if the desired-value transmitter is a transmitter which gives off an electric signal.

The closure element for the control of the idling speed can be actuated by the actuator and the regulating element for the control of the travel speed, in its turn by said closure element, it being advantageous for the closure element for the control of the idling speed to be adapted to be brought, in its open end position, into functional connection with the regulating element for the control of the speed of travel. This makes it possible in a simple manner for only the closure element for the idling speed control to be actuated by the actuator (14) in the idling position of the desired-value transmitter, while upon actuation of the desired-value transmitter the actuator actuates the regulating element for the control of the speed of travel via the closure element which controls the idling speed. Special drive units for transmission of the drive movement are unnecessary.

If the regulating element for the control of the speed of travel is a throttle valve which is mounted rigidly on a shaft which can be turned around its longitudinal axis, it is then particularly advantageous for the shaft to be a hollow shaft (3) through which an actuating shaft connected with the closure element for controlling the idling speed passes coaxially and can be driven in rotation by the actuator (14). This leads to further integration of the individual parts and thus to a further reduction in the space required for installation. In order that the throttle valve is also actually in its closed position when the desired-value transmitter is in the idling position, the hollow shaft (3) can be biased by a spring (4 and 5) into the end position that limits the rotary movement and corresponds to the closed position of the throttle valve (2). In this way uncontrolled displacement of the throttle valve is made impossible.

Between the actuating shaft (7) and the hollow shaft (3) there is preferably provided a coupling by which a rotation of the actuating shaft can be transmitted to the hollow shaft after the actuating shaft has been turned from a position corresponding to the closed position of the closure element for the idling speed regulation into a position corresponding to the open position. One simple embodiment of such a coupling comprises arranging a radially directed stop (8) on the actuating shaft or on the hollow shaft (3), the stop engaging into a groove (9) of the hollow shaft (3) or of the actuating shaft, the groove extending in circumferential direction by an angle corresponding to the opening cross section (opening course) of the closure element for the idling speed regulation.

A particularly small structural size and a simple development of the by-pass connection between the regions in front of and behind the throttle valve is obtained in the manner that the actuating shaft has an opening or recess extending from the region in front of the throttle valve to the region behind it, the opening or the recess being adapted to be brought, by relative rotation of the actuating shaft and the hollow shaft from a position in which it is completely closed by the inner wall of the hollow shaft into a position so as to overlap an opening or recess in the hollow shaft which communicates with the region in front of the throttle valve. Depending on the degree of overlap of the two openings, the cross section of passage will then vary in amount.

In a further development of the invention the actuating shaft may also be a tubular shaft (7), the coaxial bore (12) of which can be connected with the region in front of the throttle valve (2) and with the region behind the throttle valve (2). When a tubular shaft is used as an actuating shaft, the hollow shaft and the tubular shaft may each have an opening extending radially through them leading to the regions in front of and behind the throttle valve, respectively, which openings can be caused to overlap, by relative rotation of the two shafts around their longitudinal axis, the coaxial bore of the tubular shaft being thereby brought into communication with the region behind the throttle valve and the region in front of it respectively.

By this development in accordance with the invention there is created a device which on the one hand due to the elimination of the parts previously required and on the other hand due to a substantially integrated construction of regulating and closure elements, assures a construction which requires only a few parts and is compact, can be controlled by a common electronic system and requires only a small amount of space for its installation.

With the above and other objects and advantages in view, the present invention will become more clearly understood in connection with the detailed description of preferred embodiments when considered with the accompanying drawings, of which:

FIG. 1 is a cross section through a device in accordance with the invention;

FIG. 2 is a sectional view along the line II—II of FIG. 1;

FIG. 3 is a sectional view along the line III—III of FIG. 1;

FIG. 4 is a work-region diagram of the device of the invention in revolutions (U) per minute;

FIG. 5 is a cross section through a second embodiment of a device in accordance with the invention, and FIG. 6 is a sectional view along the line VI—VI of FIG. 5.

Referring to FIG. 1, an intake connection 1 is shown in cross section at the throttle valve 2. The throttle valve 2 is fixedly connected to a hollow shaft 3 which extends in the center transversely through the intake connection 1 and has its free ends supported for rotation in corresponding bores in the wall of the intake connection 1. The throttle valve 2 is urged into its closed position by springs 4 and 5 which act on one free end of the hollow shaft and on the housing 6 of the intake connection 1.

Coaxially within the hollow shaft 3 there is provided a tubular shaft 7 which is turnable around its longitudinal axis relative to the hollow shaft 3. This relative rotation is limited by a radially directed stop 8 which is fastened to the tubular shaft 7 and extends into a groove 9 extending in circumferential direction in the hollow shaft 3. The length and position of the groove 9 are such that a radially extending opening 10 in the hollow shaft 3 and a radially extending opening 11 in the tubular shaft 7 fully overlap in the one position of engagement of the stop 8 against one end of the groove and do not overlap at all in the position in which the stop is resting against the other end of the groove. Since the openings 10 and 11 extend in each case in the axial bores of the hollow shaft 3 and the tubular shaft 7 to the region of the intake connection 1 in front of the throttle valve 2, a connection between the coaxial bore 12 of the tubular shaft 7 and the region in front of the throttle valve 2 can be produced or closed off by relative rotation of the two shafts 3 and 7.

Since one end of the tubular shaft 7 is open and a connecting conduit 13 leading to the region of the intake connection 1 behind the throttle valve 2 is connected to said opening, a bypass connection of the region in front of the throttle valve 2 with the region behind the throttle valve 2 can be produced by relative rotation of the shafts 3 and 7 via the openings 10 and 11, the cross section of passage being determined by the degree of overlap of the two openings 10 and 11.

The end of the tubular shaft 7 facing away from the connecting conduit 13 is closed. The rotary drive of an actuator (setting member) 14 acts on that end.

This actuator is controlled by an electronic control system 15 to which a desired value selector transmitter 16 for control of the speed of the vehicle is connected in addition to the measured-value connections (not shown) for the measured values required for the idling speed.

As shown in FIG. 4, the actuator 14 is controlled by the electronic control system 15 in such a manner that in the idling position of the desired value transmitter 16 it operates only within an operating range 17 within which rotation of the tubular shaft 7 is possible. As a result, regulation of the idling speed of the Otto engine is effected by a greater or smaller opening of the air passage cross section at the openings 10 and 11 from the region in front of the closed throttle valve 2 to the region behind it.

If the desired value transmitter 16 is moved out of its idling position then the actuator 14 will be so acted on by the electronic control system 15 that the tubular shaft 7 will continue to turn beyond its open end position as a result of which the hollow shaft 3 will be turned by the stop 8 in opposition to the force of the springs 4 and 5. In this way the throttle valve 2 will also be turned and a direct passage at the intake connection 1 will thus be opened. This operating range of the device of the invention is designated 18 in FIG. 5.

In the same manner as in the case of the device of FIGS. 1 to 3, the device of FIGS. 5 and 6 also has a throttle valve 2 which can be driven in rotation within an intake connection 1 having a hollow shaft 3. A shaft 7 which can be driven in rotation by an actuator 14 is arranged coaxially in the hollow shaft 3 and is connected with the hollow shaft 3 in the same way as in FIGS. 1 to 3 that the hollow shaft 3 is connected with the hollow shaft 7. This connection is not shown in FIGS. 5 and 6.

The throttle valve 2 has a coaxial opening 19 which can be closed by an idle valve 20 which is rigidly connected to the shaft 7 and is of the same size as the coaxial opening 19.

The function of the embodiment shown in FIGS. 5 and 6 is in principle identical to that of the embodiment shown in FIGS. 1 to 3.

By means of an electronic control system (not shown) the actuator 14 is so controlled in a manner corresponding to FIG. 4 that it operates, in the idle position of the desired value transmitter (also not shown) only in one operating range 17, as shown in FIG. 4. Within this operating range 17 only rotation of the shaft 7 is possible.

As a result of the swinging of the idle valve 20 to a greater or lesser extent, an air passage cross section is thereby correspondingly opened or closed at the coaxial opening 19. Accordingly, air can flow from the region in front of the throttle valve 2 into the region behind the throttle valve and effect the control of the idling speed of the engine.

If the desired value transmitter is moved out of its idle position, then the actuator 14 is actuated in such a manner that the shaft 7 continues to rotate in such a manner that the shaft 7, as described in FIGS. 1 to 3, becomes operatively connected with the hollow shaft 3 and turns the latter with it. In this way the cross section of the intake connection 1 which is closed by the throttle valve 2 is opened to a greater or lesser extent so that the direct flow of air from the side in front of the throttle valve to the side behind the throttle valve 2 is made possible. This operating range corresponds to the range indicated by 18 in FIG. 5.

We claim:

1. In a system for controlling the vehicle speed of travel as well as for regulating the idling speed of automotive vehicles having an Otto engine, comprising an actuator which adjusts the position of a regulating element for control of the vehicle speed as a function of the position of a desired-value transmitter as well as a closure element which determines the through-put passage cross section of a by-pass, the latter connecting a region in front of the regulating element with a region behind the regulating element, which closure element is displaceable by an automatically controlled actuator, the improvement wherein said first-mentioned actuator and said automatically controlled actuator constitute a single actuator means common both for the controlling of the vehicle speed of travel and for regulating the idling speed, said single actuator means being for actuating the closure element for regulating the idling speed, in a first operating range and being for operating the regulating member for controlling of the vehicle speed of travel in a second operating range.

2. The device according to claim 1, further comprising:

an idling speed electronic means for controlling the actuator means in an idling position of the desired-value transmitter, and said desired-value transmitter constitutes means for controlling said actuator means upon shifting the desired-value transmitter out of said idling position.

3. The device according to claim 2, wherein said desired-value transmitter is a transmitter which emits an electric signal.

4. The device according to claim 1, wherein said actuator means is for actuating said closure element for said regulating of the idling speed, and said closure element constitutes means bringable into operative connection with and for actuating said regulating element for said controlling of the vehicle speed of travel.

5. The device according to claim 4, further comprising means for bringing said closure element for said regulating of the idling speed in an open end position thereof into said operative connection with said regulating element for the controlling of the vehicle speed of travel.

6. The device according to claim 1, wherein the regulating element for the controlling of the vehicle speed of travel is a throttle valve, a shaft mounted for rotation around its longitudinal axis, and said throttle valve is mounted rigidly on said shaft, further wherein said shaft is a hollow shaft, an actuating shaft coaxially extends through said hollow shaft and is connected with said closure element for said regulating of the idling speed, said actuator means is for rotatably driving said actuating shaft.

7. The device according to claim 6, further comprising spring means for biasing said hollow shaft into an end position limiting rotary movement and which end position corresponds to a closed position of said throttle valve.

8. The device according to claim 6, further comprising coupling means between said actuating shaft and said hollow shaft for transmitting to the latter a rotation of said actuating shaft after said actuating shaft has been turned from a position corresponding to a closed position of the closure element for the regulating of the idling speed into a position corresponding to an open position thereof.

9. The device according to claim 8, wherein said coupling means comprises a radially directed stop connected to one of said shafts, the other of said shafts being formed with a groove, said stop extends into said groove of the other of said shafts, said groove extends in a circumferential direction with an angle corresponding to the opening course of said closure element for said regulating of said idling speed.

10. The device according to claim 6, wherein said hollow shaft is formed with a first opening in front of and communicating in front of said throttle valve, said actuating shaft is formed with a second opening extending from a region in front of the throttle valve to operative communication with a region behind said throttle valve, said second opening being arranged relative to said first opening so as to be brought by relative rotation of said actuating shaft with respect to said hollow shaft from a position in which said second opening is completely closed by an inner wall of said hollow shaft into a position in which said second opening overlaps said first opening.

11. The device according to claim 10, wherein said actuating shaft is a tubular shaft having a coaxial bore, the latter being connectable with the region behind the throttle valve.

12. The device according to claim 6, wherein said closure element constitutes, a valve means connected jointly with said actuating shaft, said throttle valve is formed with an opening, said valve means for cooperating with said opening in said throttle valve for opening and closing, respectively, said opening in said throttle valve.

13. The device as set forth in claim 1, wherein said closure element and said regulating element are mounted to permit relative movement between each other over a limited region of motion, said single actuator means actuating the closure element for regulating the idling speed, in said first operating range which constitutes said limited region of motion.

* * * * *